US008134488B2

(12) United States Patent
Peng

(10) Patent No.: US 8,134,488 B2
(45) Date of Patent: Mar. 13, 2012

(54) REMOTE CONTROLLER FOR PORTABLE MOBILE NETWORK DEVICE

(75) Inventor: Juen Tien Peng, Shenzhen (CN)

(73) Assignee: Action Technology (SZ) Co., Ltd., Shenzhen (CN)

( * ) Notice: Subject to any disclaimer, the term of this patent is extended or adjusted under 35 U.S.C. 154(b) by 769 days.

(21) Appl. No.: 12/253,376

(22) Filed: Oct. 17, 2008

(65) Prior Publication Data

US 2009/0322581 A1 Dec. 31, 2009

(30) Foreign Application Priority Data

Jun. 27, 2008 (CN) ..... 2008 1 0068137

(51) Int. Cl.
*G08C 19/12* (2006.01)

(52) U.S. Cl. ..... 341/176; 341/173

(58) Field of Classification Search ..... 341/176, 341/169, 173
See application file for complete search history.

(56) References Cited

U.S. PATENT DOCUMENTS

| | | | | |
|---|---|---|---|---|
| 5,294,915 | A | 3/1994 | Owen | |
| 7,224,801 | B2 * | 5/2007 | Abdo et al. | 380/270 |
| 7,283,084 | B2 | 10/2007 | Di Peppe | |
| 2002/0044071 | A1 * | 4/2002 | Ding-Yuu | 341/22 |
| 2004/0155867 | A1 * | 8/2004 | Lin | 345/168 |

* cited by examiner

*Primary Examiner* — Danny Nguyen
(74) *Attorney, Agent, or Firm* — Morris Manning & Martin LLP; Tim Tingkang Xia, Esq.

(57) ABSTRACT

An exemplary remote controller for a mobile internet device includes a remote control module, a center control module, and a wireless transmitter. The mobile internet device includes a wireless receiver disposed therein. The remote control module generates a control signal. The center control module determines whether the control signal is legal. The transmitter reads out a wireless data from the control signal and transmits to the wireless receiver. A remote control system and method thereof are also provided.

15 Claims, 4 Drawing Sheets

REMOTE CONTROLLER FOR PORTABLE MOBILE NETWORK DEVICE

BACKGROUND OF THE INVENTION

1. Field of the Invention

The present invention relates to a remote controller, a remote control system and method thereof, and more particularly, to a remote controller, a remote control system and method thereof which are used to economically and conveniently control a mobile internet device.

2. Background

Recently, smaller sized portable or mobile devices are provided, such as UMPC (Ultra Mobile PC), UMD (Ultra Mobile Device), MID (Mobile Internet Device). MID is a new category of small mobile devices for consumers and business professionals. This latest generation of small, powerful, highly portable Internet-connected devices combines many great capabilities with the convenience of a pocket-sized solution for users. In personal computers, Ultra-Mobile PC (often abbreviated UMPC) is a small form factor (a standard size and shape) for tablet PCs, which was developed as Project Origami. This project is a joint development exercise by Microsoft, Intel, and Samsung, among others. Intel is also responsible for the Mobile Internet Device, a variation on the UMPC concept. The term has gained a second meaning as a synonym for subnotebook or netbook recently.

Generally, one kind of input devices of the UMPC, UMD, and MID are keyboards electronically connected thereto by lines, the other kind of input devices of the UMPC, UMD, and MID are touchpanels. However, it is very inconvenient for those UMPC, UMD, and MID with keyboard during transportation. Furthermore, it is cost to use touch panels as I/O devices.

What is needed, therefore, is remote controller, a remote control system and method thereof which are used to economically and conveniently control a mobile internet device.

SUMMARY OF THE INVENTION

To overcome the above problems, it is an objective of the present invention to provide a remote controller of which are used to economically and conveniently control a mobile internet device.

An exemplary remote controller for a mobile internet device includes a remote control module, a center control module, and a wireless transmitter. The mobile internet device includes a wireless receiver disposed therein. The remote control module generates a control signal. The center control module determines whether the control signal is legal. The transmitter reads out a wireless data from the control signal and transmits to the wireless receiver.

Other advantages and novel features will become more apparent from the following detailed description of preferred embodiment when taken in conjunction with the accompanying drawings, in which:

DETAILED DESCRIPTION OF THE INVENTION

Figure 1:
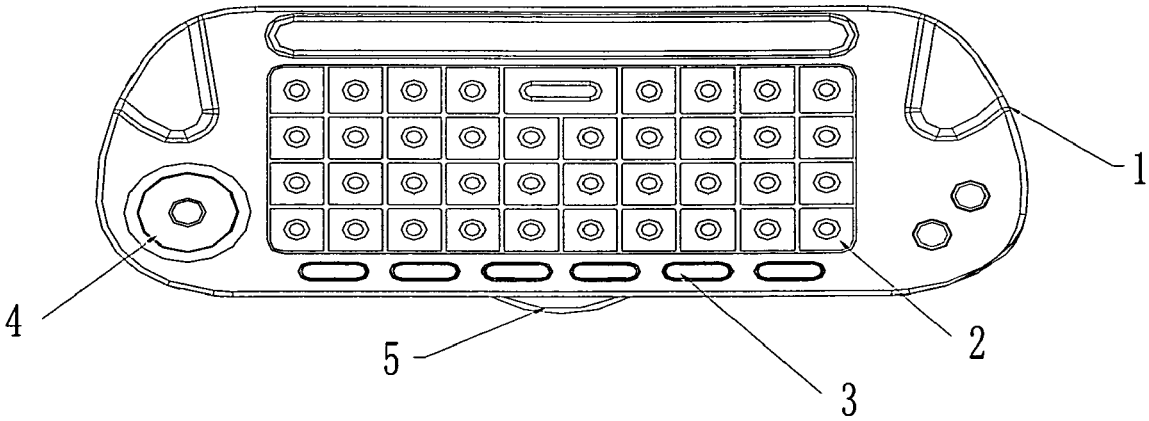
FIG. 1 is an isometric view of a remote controller of a remote control system in accordance with a preferred embodiment of the present invention.
Figure 2:
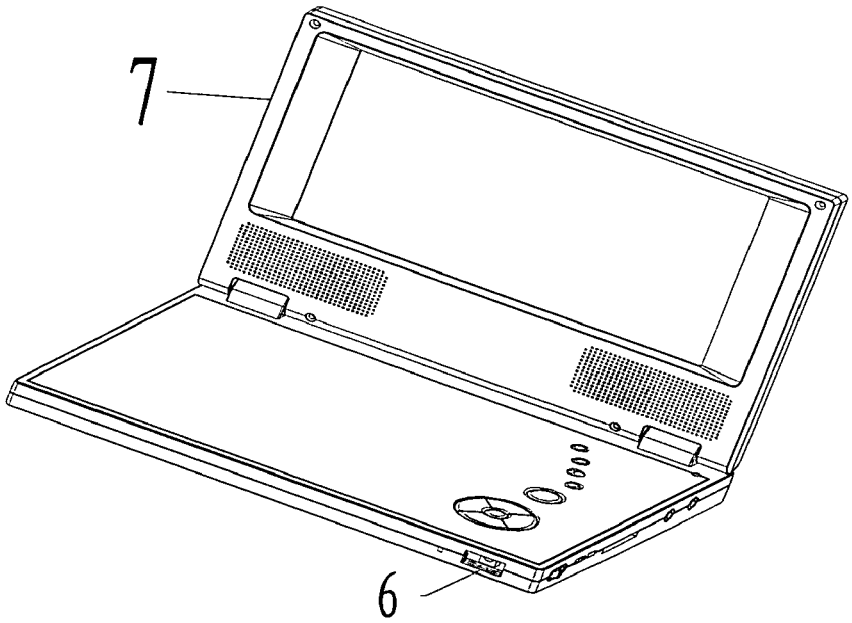
FIG. 2 is an isometric view of a mobile internet device of a remote control system in accordance with a preferred embodiment of the present invention.

Referring to FIGS. 1 and 2, a remote control system in accordance with a preferred embodiment of the present invention includes a remote controller, and a mobile internet device (MID) 7.

The remote controller with a configuration similar to a computer keyboard and includes a remote control module 1, a wireless transmitter 5, and a center control module (not shown). In this preferred embodiment, the remote control module has a shape of a computer keyboard and includes a plurality of main keys 2, a plurality of function keys 3, and a plurality of direction keys 4. The main keys 2 include alphabet keys from A to Z, symbol keys, and Num keys from zero to nine. The function keys 3 include keys of Caps/Shift, Tab, Option, Ctrl, Space, Enter, and Del. The direction keys include up, down, left and right direction keys. In this preferred embodiment, the wireless transmitter 5 is an infra-red radiation transmitter and disposed in remote control module 1. In this preferred embodiment, the center control module is disposed in the remote control module 1.

In this preferred embodiment, the MID 7 is a portable computer and includes a wireless receiver 6. In this preferred embodiment, the wireless receiver 6 is an infra-red radiation receiver.

In others embodiments, the MID 7 may be an ultra portable computer, or an ultra mobile device.

The wireless receiver 6 and the wireless transmitter 5 composes a wireless transmission device. In others embodiments, the wireless transmission device may be a blue tooth wireless transmission device, or a Wi-Fi wireless transmission device.

Figure 3:
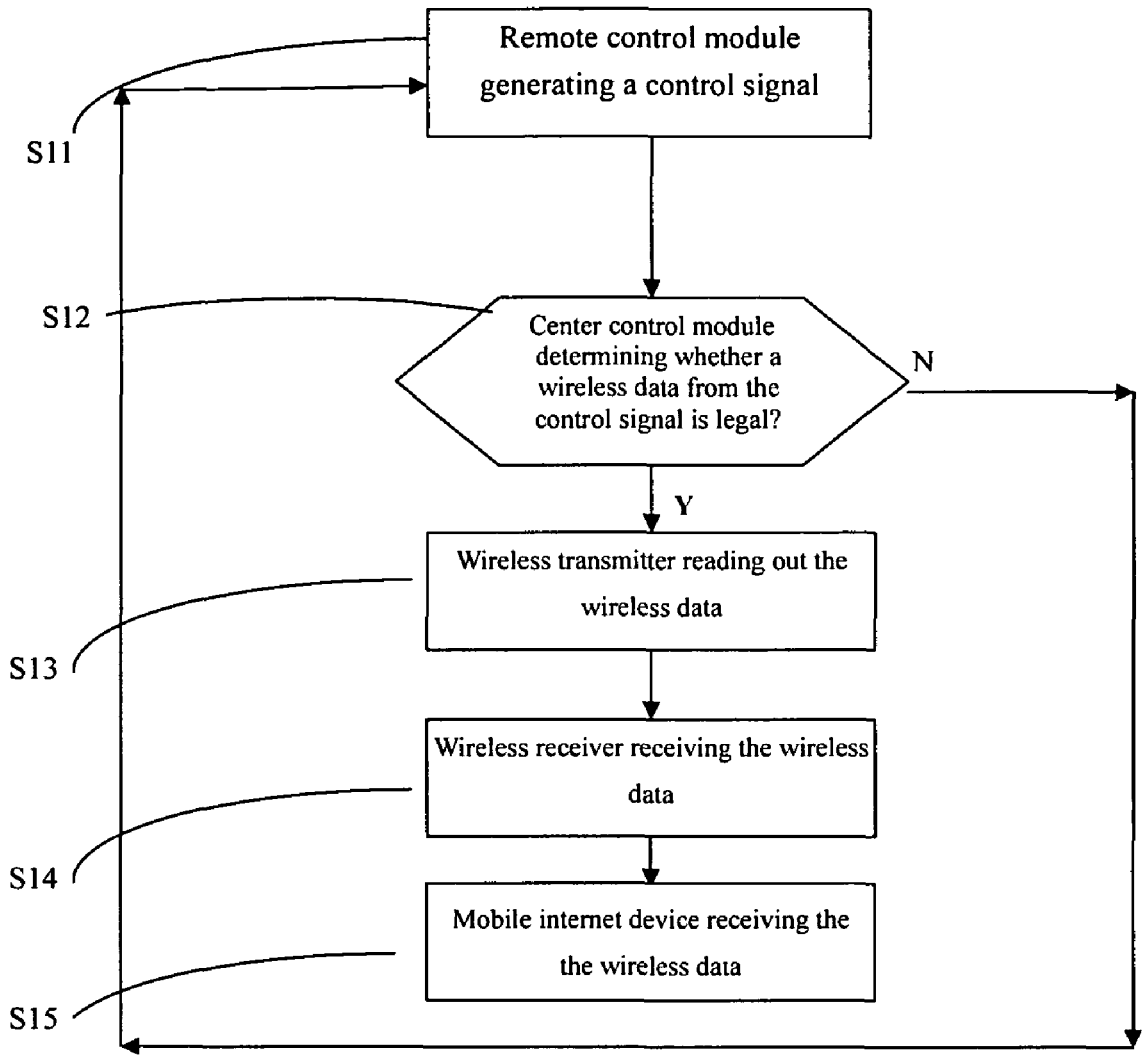
FIG. 3 is a flowchart of a remote control method in accordance with a preferred embodiment of the present invention.

Referring to FIG. 3, a remote control method in accordance with a preferred embodiment of the present invention includes the following steps.

In step s11, a control signal is generated from the remote control module 1 of the remote controller. In this preferred embodiment, the control signal is obtained by operating remote control module 1.

In step s12, the center control module of the remote controller judging whether the control signal is legal.

In step s13, if the control signal is legal, the wireless transmitter 5 reads out a wireless data from the control signal to be transmitted to the MID 7

In step s14, the MID 7 receiving and processing the wireless data.

In step s15, If the control signal is illegal, returns to step s11.

Figure 4:
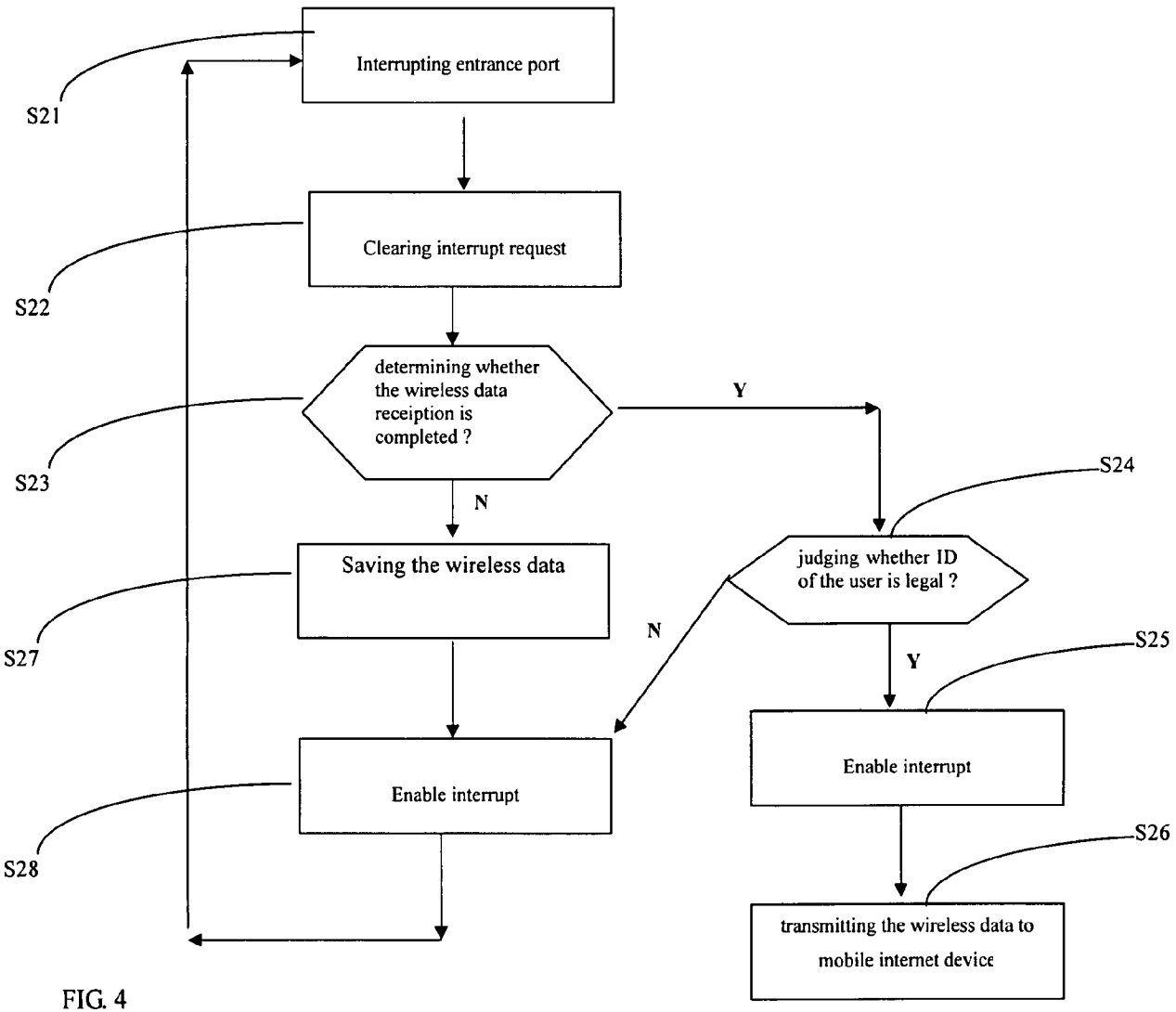
FIG. 4 is a flowchart of an interrupt request processing method of a mobile internet device in accordance with a preferred embodiment of the present invention.

Referring to FIG. 4, an interrupt request processing method of the MID 7 to receive the wireless data in accordance with a preferred embodiment of the present invention includes the following steps.

In step s21, interrupting entrance port.

In step s22, clearing interrupt requests.

In step s23, determining whether the wireless data reception is completed.

In step s24, if the data reception is completed, judging whether ID of the user is legal.

In step s25, if the ID of the user is legal, enable the interrupt request.

In step s26, transmitting the wireless data to the MID 7.

In step s27, if the data reception is not completed, saving the infra-red radiation wireless data.

In step s28, enable the interrupt request and returning to step s21.

if the ID of the user is illegal, go to step s28.

Figure 5:
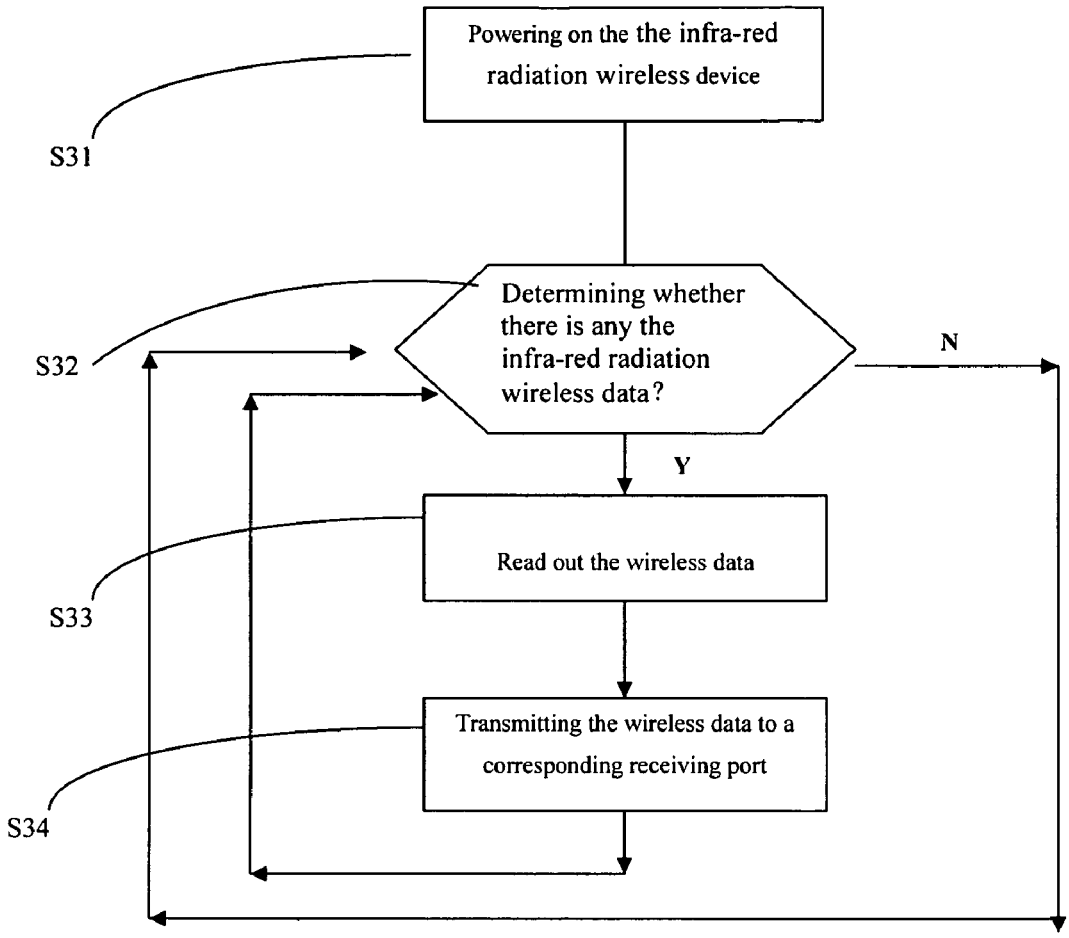
FIG. 5 is a flow chart of a remote control method of an infra-red radiation transmission device in accordance with the preferred embodiment of the present invention.

Referring to FIG. 5, a control method of an infra-red radiation transmission device in accordance with a preferred embodiment of the present invention includes the following steps.

In step s31, powering on an infra-red radiation transmission device.

In step s32, infra-red radiation transmission device determines whether there is an infra-red radiation wireless data.

In step s33, if there is an infra-red radiation wireless data, reading out the wireless data.

In step s34, transmitting the wireless data to a corresponding data receiving port and then returning to step s32.

In step s35, if there is not an infra-red radiation wireless data, returning to step s32.

It is believed that the present embodiment and its advantages will be understood from the foregoing description, and it will be apparent that various changes may be made thereto without departing from the spirit and scope of the invention or sacrificing all of its material advantages, the example hereinbefore described merely being preferred or exemplary embodiment of the invention.

What is claimed is:

1. A remote control system comprising:

a remote controller comprising a remote control module, a wireless transmitter, and a center control module; and a mobile internet device comprising a wireless receiver;

wherein the remote control module generates a control signal, the center control module determines whether the control signal is legal, if the control signal is legal, the wireless transmitter reads out a wireless data from the control signal and transmits to the wireless receiver, if the control signal is illegal, the remote control module generates a control signal once more; and wherein the wireless receiver receiving the wireless data comprises an interrupt request processing method comprising:

interrupting entrance port;

clearing interrupt requests;

determining whether the wireless data reception is completed;

if the data reception is not completed, saving the wireless data and enable the interrupt;

if the data reception is completed, judging whether ID of an user is legal;

if the ID of the user is legal, enable the interrupt request and transmitting the wireless data to the mobile internet device; and if the data reception is not completed, saving the wireless data and enable the interrupt.

2. A remote control system as claimed in claim 1, wherein the wireless transmitter and receiver composes a wireless transmission device.

3. A remote control system as claimed in claim 2, wherein the wireless transmitter and receiver are infra-red radiation wireless devices.

4. A remote control system as claimed in claim 2, wherein the wireless transmitter and receiver are blue-teeth wireless devices.

5. A remote control system as claimed in claim 2, wherein the wireless transmitter and receiver are Wi-Fi wireless devices.

6. A remote control system as claimed in claim 1, wherein the remote control module has a shape of a keyboard, the wireless transmitter is disposed in the remote control module.

7. A remote control system as claimed in claim 6, wherein the remote control module comprises a plurality of main keys, Num keys, function keys, and direction keys.

8. A remote control system as claimed in claim 1, wherein the mobile internet device is a portable computer, the wireless receiver is arranged in the portable computer.

9. A remote control system as claimed in claim 1, wherein the mobile internet device is an ultra portable computer, the wireless receiver is arranged in the ultra portable computer.

10. A remote control system as claimed in claim 1, wherein the mobile internet device is an ultra portable device, the wireless receiver is arranged in the ultra portable device.

11. A remote control method of a remote control system, the method comprising:

generating a control signal by a remote control module of a remote controller of the remote control system;

determining whether the control signal is legal by a center control module of the remote controller of the remote control system;

if the control signal is legal, transmitting a wireless data from the control signal to a wireless transmitter of the remote controller of the remote control system;

receiving the wireless data by a wireless receiver of a mobile internet device of the remote control system; and if the control signal is illegal, generating a control signal by the remote control module once more, and wherein the wireless receiver receiving the wireless data comprises an interrupt request processing method comprising:

interrupting entrance port;

clearing interrupt requests;

determining whether the wireless data reception is completed;

if the data reception is not completed, saving the wireless data and enable the interrupt;

if the data reception is completed, judging whether ID of an user is legal;

if the ID of the user is legal, enable the interrupt request and transmitting the wireless data to the mobile internet device; and if the data reception is not completed, saving the wireless data and enable the interrupt.

12. A remote control method as claimed in claim 11, wherein the wireless transmitter and receiver composes a wireless transmission device.

13. A remote control method as claimed in claim 12, wherein the wireless transmission device is an infra-red radiation wireless device, a blue-teeth wireless device, or a Wi-Fi wireless device.

14. A remote control method as claimed in claim 11, wherein the remote control module has a shape of a keyboard, the wireless transmitter is disposed in the remote control module.

15. A remote control method as claimed in claim 14, wherein the mobile internet device is a portable computer, an ultra portable computer, or an ultra portable device.

* * * * *